US009111489B2

(12) United States Patent
Park et al.

(10) Patent No.: US 9,111,489 B2
(45) Date of Patent: Aug. 18, 2015

(54) ORGANIC LIGHT EMITTING DISPLAY DEVICE AND METHOD OF DRIVING THE SAME

(71) Applicant: LG DISPLAY CO., LTD., Seoul (KR)

(72) Inventors: Jeong Hyo Park, Gunpo-si (KR); Bum Sik Kim, Suwon-si (KR); Jung Hyeon Kim, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 83 days.

(21) Appl. No.: 14/085,368

(22) Filed: Nov. 20, 2013

(65) Prior Publication Data

US 2014/0176400 A1 Jun. 26, 2014

(30) Foreign Application Priority Data

Dec. 24, 2012 (KR) ..... 10-2012-0152550

(51) Int. Cl.
*G09G 3/32* (2006.01)

(52) U.S. Cl.
CPC ..... *G09G 3/3233* (2013.01); *G09G 3/3291* (2013.01); *G09G 2300/043* (2013.01); *G09G 2310/0251* (2013.01); *G09G 2320/045* (2013.01); *G09G 2320/0606* (2013.01)

(58) Field of Classification Search
CPC ..... G09G 3/3233; G09G 2320/045; G09G 2320/043; G09G 2320/0295; G09G 3/3208; G09G 2300/0819; G09G 2300/0861; G09G 3/3291; G09G 2320/0233; G09G 2300/0866; G09G 2300/043; G09G 2320/02; G09G 2310/0251; G09G 2320/0606
USPC ..... 345/76–84; 315/169.3
See application file for complete search history.

(56) References Cited

U.S. PATENT DOCUMENTS

| | | | | |
|---|---|---|---|---|
| 2007/0128583 | A1* | 6/2007 | Miyazawa | 434/433 |
| 2008/0024526 | A1* | 1/2008 | Ko et al. | 345/690 |
| 2008/0036703 | A1* | 2/2008 | Wang et al. | 345/76 |
| 2008/0224964 | A1* | 9/2008 | Tanikame et al. | 345/76 |
| 2008/0238901 | A1* | 10/2008 | Taneda et al. | 345/204 |
| 2009/0115709 | A1* | 5/2009 | Yamashita et al. | 345/76 |
| 2009/0219235 | A1* | 9/2009 | Yamamoto et al. | 345/80 |
| 2009/0295785 | A1* | 12/2009 | Yamamoto et al. | 345/214 |
| 2010/0253706 | A1* | 10/2010 | Shirouzu | 345/690 |
| 2011/0122119 | A1* | 5/2011 | Bae et al. | 345/211 |
| 2014/0159996 | A1* | 6/2014 | Nathan et al. | 345/77 |

* cited by examiner

*Primary Examiner* — Dmitriy Bolotin
(74) *Attorney, Agent, or Firm* — Brinks Gilson & Lione

(57) ABSTRACT

Disclosed are an organic light emitting display device and a method of driving the same. The organic light emitting display device includes a display panel including a plurality of pixels including a pixel circuit for emitting light from an organic light emitting diode and a driving circuit unit driving the display panel. The driving method includes sensing a characteristic of a driving TFT of each of the pixels of the display panel to generate sensing data according to a user's setting using an input device, at a predetermined compensation driving time, or when an error occurs in sensing data generated by real-time sensing of each pixel of the display panel, and compensating for the characteristic of the driving TFT of each pixel by using the sensing data.

8 Claims, 6 Drawing Sheets

ORGANIC LIGHT EMITTING DISPLAY DEVICE AND METHOD OF DRIVING THE SAME

CROSS-REFERENCE TO RELATED APPLICATIONS

This application claims the benefit of priority to Korean Patent Application No. 10-2012-0152550 filed on Dec. 24, 2012, which is hereby incorporated by reference as if fully set forth herein.

BACKGROUND

1. Field of the Disclosure

The present disclosure relates to an organic light emitting display device, and more particularly, to an organic light emitting display device and a method of driving the same, which can reduce real-time sensing errors and thus increase an accuracy of real-time compensation.

2. Discussion of the Related Art

General organic light emitting display devices include a display panel, which includes a plurality of pixels respectively formed in a plurality of pixel areas defined by intersections between a plurality of data lines and a plurality of gate lines, and a panel driver that emits light from the plurality of pixels.

FIG. 1 is a circuit diagram for illustrating a pixel structure of a related art organic light emitting display device.

Referring to FIG. 1, each pixel of the display panel includes a first switching TFT ST1, a second switching TFT ST2, a driving TFT DT, a capacitor Cst, and an organic light emitting diode OLED.

The first switching TFT ST1 is turned on according to a scan signal (gate driving signal) supplied to a corresponding gate line GL. The first switching TFT ST1 is turned on, and thus, a data voltage Vdata supplied to a corresponding data line DL is supplied to the driving TFT DT.

The driving TFT DT is turned on with the data voltage Vdata supplied to the first switching TFT ST 1. A data current Ioled flowing to the organic light emitting diode OLED is controlled with a switching time of the driving TFT DT. A first driving voltage VDD is supplied to a power line PL, and, when the driving TFT DT is turned on, the data current Ioled is applied to the organic light emitting diode OLED.

The capacitor Cst is connected between a gate and source of the driving TFT DT. The capacitor Cst stores a voltage corresponding to the data voltage Vdata supplied to the gate of the driving TFT DT. The driving TFT DT is turned on with the voltage stored in the capacitor Cst.

A plurality of the sensing signal lines SL are formed in the same direction as that of the gate line GL. A second switch TFT ST2, which is turned on according to a sensing signal applied to a corresponding sensing signal line SL, is provided in plurality. The second switch TFT ST2 is turned on, and a current or voltage flowing in a corresponding organic light emitting diode OLED may be sensed by an analog-to-digital converter (ADC) of a data driver.

The organic light emitting diode OLED is electrically connected between the source of the driving TFT DT and a cathode voltage VSS. The organic light emitting diode OLED emits light with the data current Ioled supplied from the driving TFT DT.

The related art organic light emitting display device controls a level of the data current Ioled flowing from a first driving voltage VDD terminal to the organic light emitting diode OLED with a switching time of the driving TFT DT based on the data voltage Vdata. Therefore, the organic light emitting diode OLED of each pixel emits light, thereby realizing an image.

However, the threshold voltage (Vth) and mobility characteristics of the driving TFTs DT of the respective pixels are differently shown due to a non-uniformity of a TFT manufacturing process. For this reason, in general organic light emitting display devices, despite that the same data voltage Vdata is applied to the driving TFTs DT of the respective pixels, since a deviation of currents flowing in the respective organic light emitting diodes OLED occurs, it is unable to realize a uniform image quality.

To overcome such limitations, the display panel has been manufactured, and then, before a product is released, the display device performs an initial compensation operation that senses the characteristics of the driving TFTs of all the pixels, and compensates for a characteristic deviation of the driving TFTs of all the pixels.

FIG. 2 is a diagram for describing a display and sensing driving method of a related art organic light emitting display device. FIG. 2 illustrates a driving mode and sensing mode driving method after the display panel is released as a product.

Referring to FIG. 2, in the driving mode where an image is displayed, data voltages Vdata corresponding to image data are respectively supplied to the first data line to the last data line during a period of an Nth frame, thereby enabling an image to be displayed. Like this, when the display panel is driven to display an image, the driving TFTs are deteriorated.

The display device operates in the sensing mode, and compensates for a deterioration of the driving TFTs. The display device sequentially supplies a sensing signal in units of one horizontal line during a blank interval (about 350 us in the case of 120 Hz) between an nth frame and an n+1st frame to perform real-time sensing. The display device converts sensing data, generated by real-time sensing, into compensation data corresponding to a threshold voltage/mobility of the driving TFT DT of each pixel P. The display device compensates for the pixels in units of one horizontal line in real time using the compensation data.

In this way, the display device detects a threshold voltage/mobility of the driving TFT DT of each pixel of the display panel during the blank interval between a plurality of frames. The display device compensates for a characteristic of the driving TFT of each pixel using the compensation data based on the detected threshold voltage/mobility.

However, a real-time compensation scheme based on real-time sensing is short in sensing time, and thus is high in probability that an error occurs. Also, since sensing is affected by a data voltage, which is supplied to each pixel for displaying an image, an accuracy and reliability of sensing data is reduced. Also, since the display device is vulnerable to external factors such as a temperature (low temperature or high temperature), a change (surge voltage) in main power, dust, lightning, etc., a sensing error can occur, and for this reason, an accuracy and reliability of real-time compensation are low.

SUMMARY

A method of driving an organic light emitting display device, which includes a display panel including a plurality of pixels including a pixel circuit for emitting light from an organic light emitting diode and a driving circuit unit driving the display panel, includes: sensing a characteristic of a driving thin film transistor (TFT) of each of the pixels of the display panel to generate sensing data according to a user's setting using an input device, at a predetermined compensation driving time, or when an error occurs in sensing data generated by real-time sensing of each pixel of the display panel; and compensating for the characteristic of the driving TFT of each pixel by using the sensing data.

In another aspect of the present invention, an organic light emitting display device includes a display panel including a plurality of pixels including a pixel circuit for emitting light from an organic light emitting diode and a driving circuit unit driving the display panel, including: a determination unit configured to load sensing data, generated by sensing driving, from a data driver of the driving circuit, and analyze the sensing data to determine whether to perform a compensation mode on a characteristic of driving TFTs of all or some of the plurality of pixels; a compensation unit configured to calculate a change in characteristic of the driving TFT of each of the plurality of pixels by using the sensing data to generate compensation data used to compensate for the characteristic of the driving TFT of each pixel; a panel driving unit configured to correct external input data by using the compensation data to supply the corrected pixel data to the data driver, according to an input compensation mode, a predetermined compensation driving time, or the determined result by the determination unit; and an input device configured to generate a compensation mode selection signal according to selection of the compensation mode by a user, and supply the compensation mode selection signal to the compensation unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EXEMPLARY EMBODIMENTS

Figure 1:
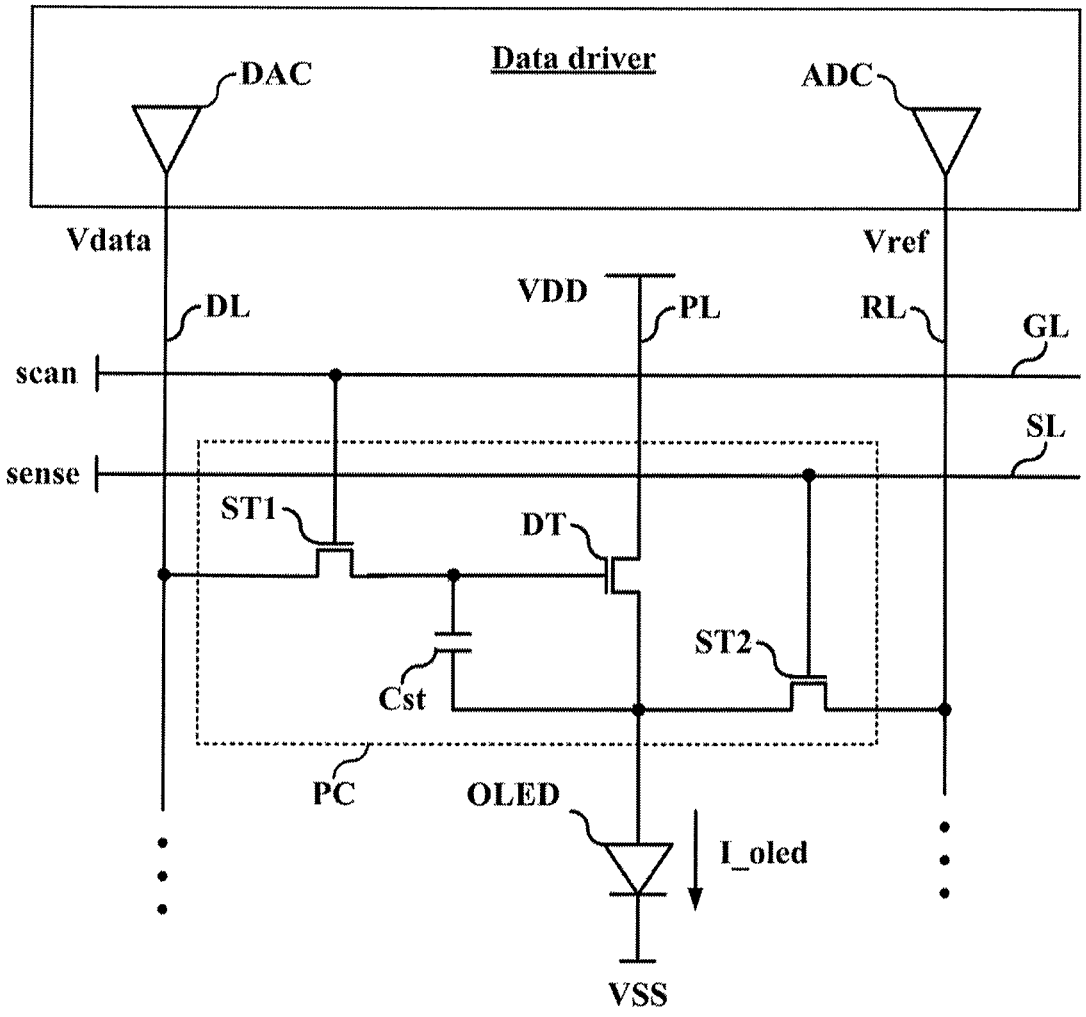
FIG. 1 Related Art
FIG. 1 is a circuit diagram for describing a pixel structure of a related art organic light emitting display device.
Figure 2:
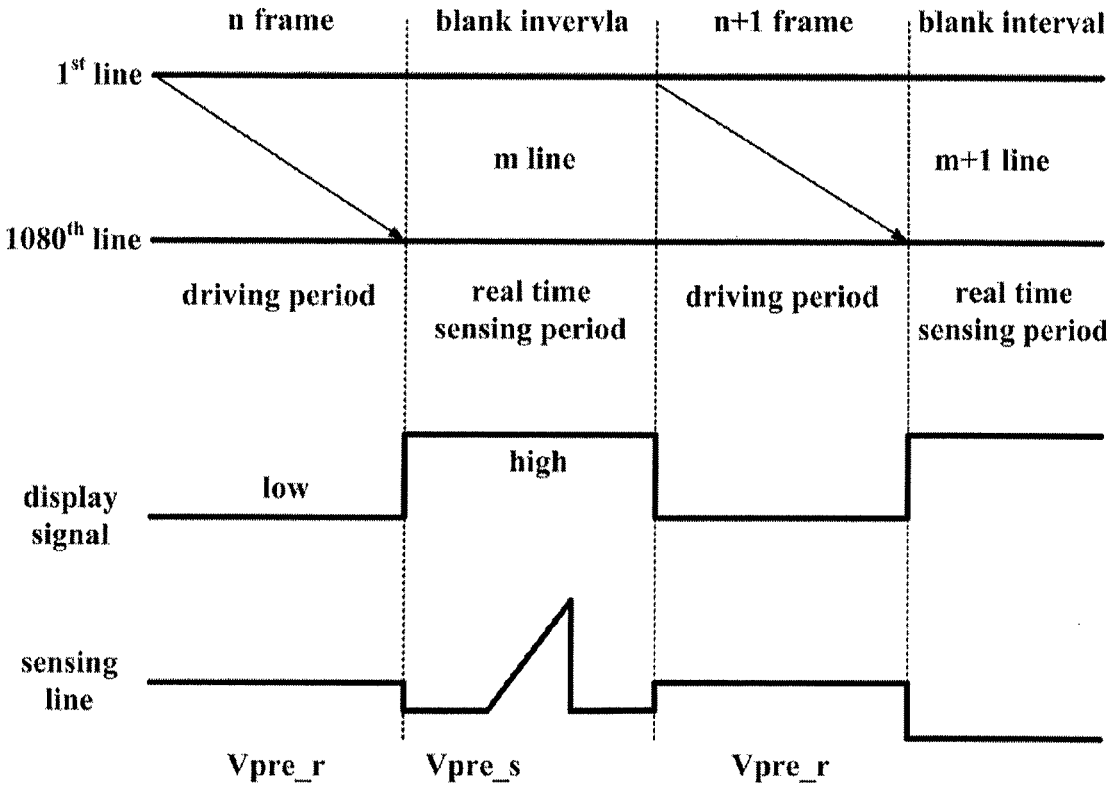
FIG. 2 Related Art
FIG. 2 is a diagram for describing a display and sensing driving method of a related art organic light emitting display device.

In the specification, in adding reference numerals for elements in each drawing, it should be noted that like reference numerals already used to denote like elements in other drawings are used for elements wherever possible.

The terms described in the specification should be understood as follows.

As used herein, the singular forms "a", "an" and "the" are intended to include the plural forms as well, unless the context clearly indicates otherwise. The terms "first" and "second" are for differentiating one element from the other element, and these elements should not be limited by these terms.

It will be further understood that the terms "comprises", "comprising,", "has", "having", "includes" and/or "including", when used herein, specify the presence of stated features, integers, steps, operations, elements, and/or components, but do not preclude the presence or addition of one or more other features, integers, steps, operations, elements, components, and/or groups thereof.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Hereinafter, embodiments of an organic light emitting display device and a method of driving the same according to the present invention will be described in detail with reference to the accompanying drawings.

A compensation scheme is categorized into an internal compensation scheme and an external compensation scheme depending on a position of a circuit that compensates for a characteristic deviation of pixels. The internal compensation scheme is a scheme in which a compensation circuit for compensating for a characteristic deviation of pixels is disposed inside each of the pixels. The external compensation scheme is a scheme in which the compensation circuit for compensating for a characteristic deviation of pixels is disposed outside each pixel. The present invention relates to an organic light emitting display device using the external compensation scheme and a method of driving the same.

Figure 3:
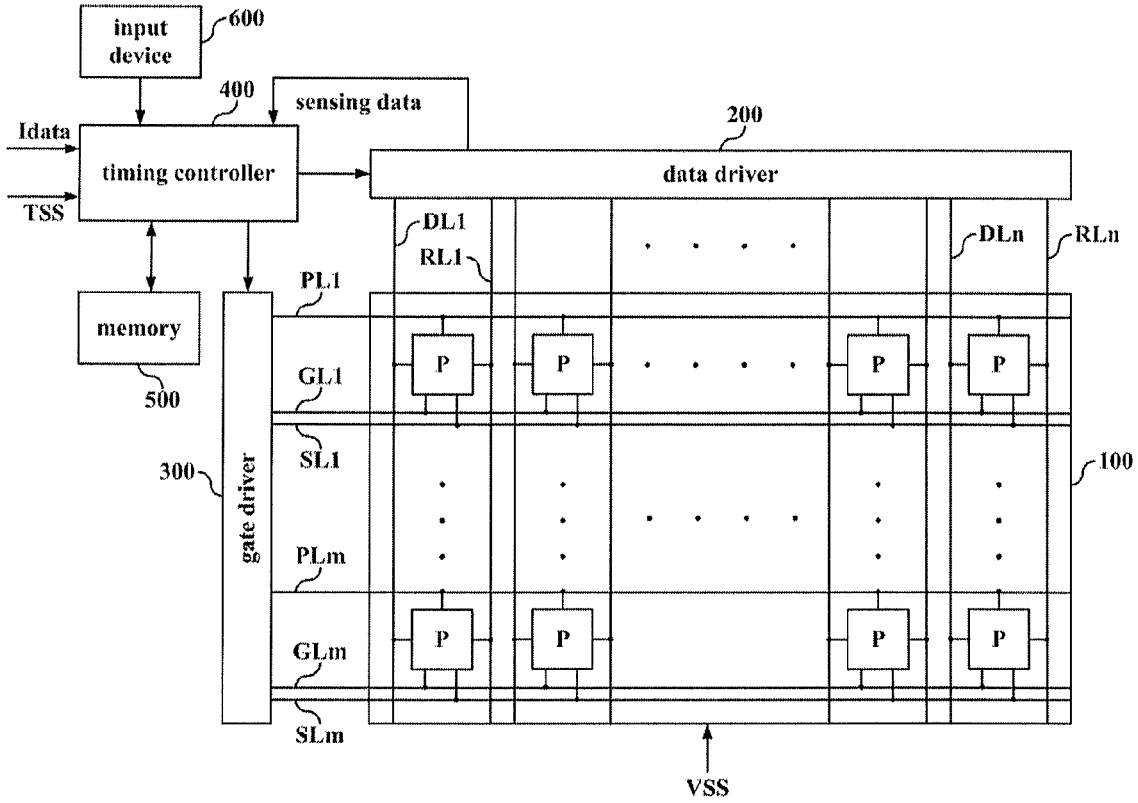
FIG. 3 is a diagram schematically illustrating an organic light emitting display device according to an embodiment of the present invention.
Figure 4:
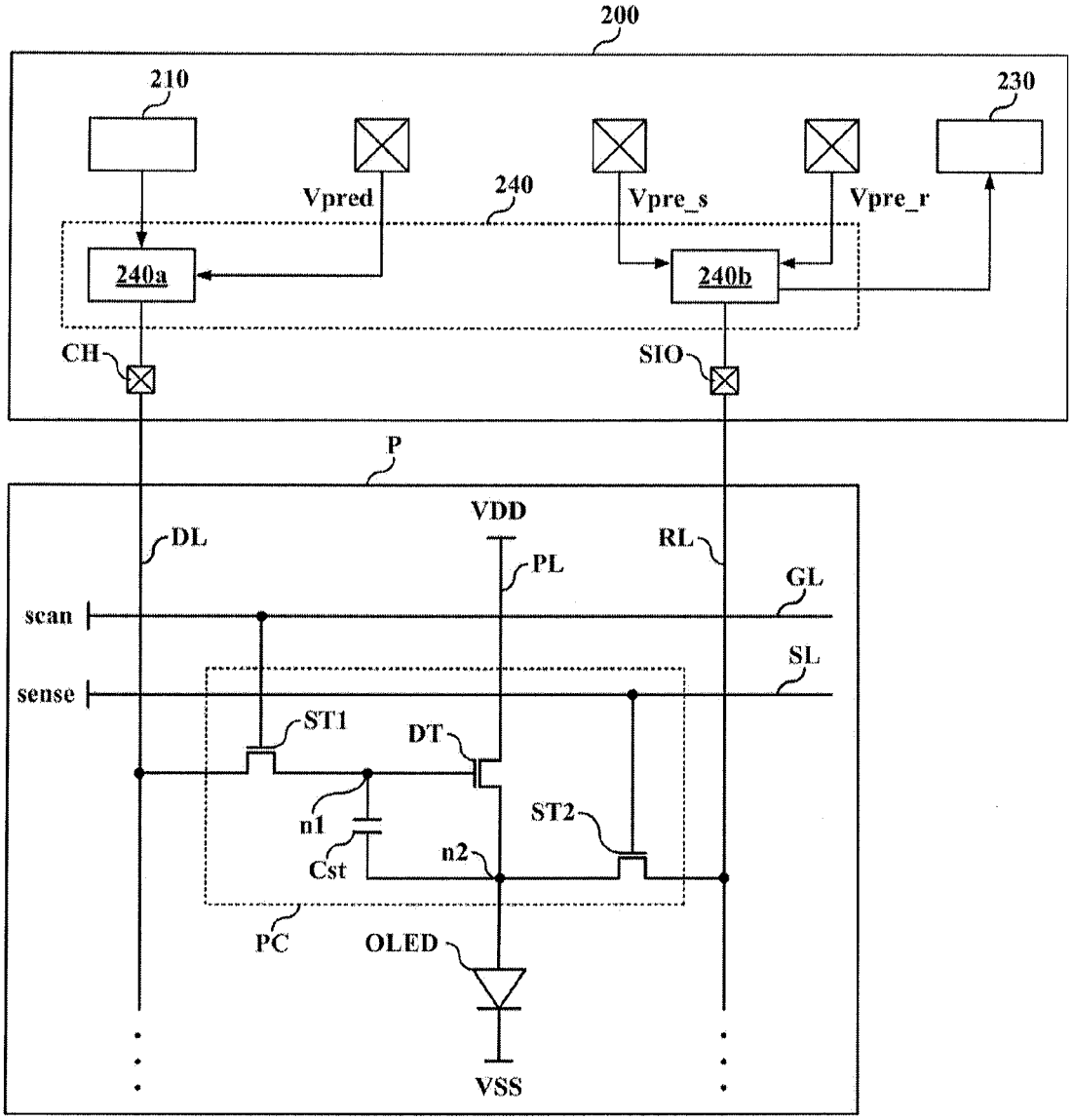
FIG. 4 is a circuit diagram for describing a data driver and pixel structure of the organic light emitting display device according to an embodiment of the present invention.

FIG. 3 is a diagram schematically illustrating an organic light emitting display device according to an embodiment of the present invention. FIG. 4 is a circuit diagram for describing a data driver and pixel structure of the organic light emitting display device according to an embodiment of the present invention.

Referring to FIGS. 3 and 4, the organic light emitting display device according to an embodiment of the present invention includes a display panel 100 and a driving circuit unit.

The driving circuit unit includes a data driver 200, a gate driver 300, a timing controller 400, and a memory 500 storing compensation data.

The display panel 100 includes a plurality of gate lines GL, a plurality of sensing signal lines SL, a plurality of data lines DL, a plurality of driving power lines PL, a plurality of reference power lines RL, and a plurality of pixels P.

Each of the plurality of pixels P includes an organic light emitting diode OLED and a pixel circuit PC for emitting light from the organic light emitting diode OLED. A difference voltage (Vdata−Vref) between a data voltage Vdata and a reference voltage Vref is charged into a capacitor Cst connected between a gate and source of a driving TFT DT. The driving TFT DT is turned on with a voltage charged into the capacitor Cst. The organic light emitting diode OLED emits light with a data current Ioled which flows from a first driving voltage VDD terminal to a second driving voltage VSS terminal through the driving TFT DT.

Each of the pixels P may include one of a red pixel, a green pixel, a blue pixel, and a white pixel. One unit pixel for displaying one image may include adjacent red pixel, green pixel, and blue pixel, or may include adjacent red pixel, green pixel, blue pixel, and white pixel.

Each of the plurality of pixels P is formed in a pixel area defined in the display panel 100. To this end, the plurality of gate lines GL, the plurality of sensing signal lines SL, the plurality of data lines DL, the plurality of driving power lines PL, and the plurality of reference power lines RL are formed in the display panel 100 in order to define the pixel area.

The plurality of gate lines GL and the plurality of sensing signal lines SL may be parallelly formed in a first direction (for example, a horizontal direction) in the display panel 100. A scan signal (gate driving signal) is applied from the gate driver 300 to the gate lines GL. A sensing signal is applied from the gate driver 300 to the sensing signal lines SL.

The plurality of data lines DL may be formed in a second direction (for example, a vertical direction) to intersect the plurality of gate lines GL and the plurality of sensing signal lines SL. Data voltages Vdata are respectively supplied from the data driver 200 to the data lines DL. Each of the data voltages Vdata has a voltage level to which a compensation voltage corresponding to a change in characteristic (threshold voltage/mobility) of a driving TFT DT of a corresponding pixel P is added.

Compensation of the characteristic (threshold voltage/mobility) of the driving TFT of each pixel of the display panel 100 may be performed by using a sensing voltage and compensation voltage for characteristic (threshold voltage/mobility) of the driving TFTs according to a user's setting using an input device.

As another example, a sensing and compensation time may be set, and compensation of the characteristic (threshold voltage/mobility) of the driving TFTs may be performed by using the sensing voltage and compensation voltage for characteristic (threshold voltage/mobility) of the driving TFTs, according to a user's setting using the input device.

As another example, compensation of the characteristic (threshold voltage/mobility) of the driving TFTs using the sensing voltage and compensation voltage may be performed for a certain time by using the sensing voltage and compensation voltage for characteristic (threshold voltage/mobility) of the driving TFTs, and then automatically performed.

A sensing/compensation operation based on a user's setting may be performed in two kinds of modes.

A first sensing/compensation mode may be performed as follows. The display device may sense all the pixels according to a user's setting using the input device, and compensate for all the pixels by using sensing data based on the sensing.

A second sensing/compensation mode may be performed as follows. In a driving mode where an image is displayed according to a user's setting using the input device, the display device may sequentially sense a plurality of pixels in units of one horizontal line in real time during a blank interval between frames. Furthermore, the display device may sequentially compensate for the plurality of pixels in units of one horizontal line in real time by using the sensing data based on the real-time sensing.

As illustrated in FIG. 4, the plurality of reference power lines RL are formed in parallel to the plurality of data lines DL. A display reference voltage Vpre_r or a sensing precharging voltage Vpre_s may be selectively supplied from the data driver 200 to each of the reference power lines RL. At this time, the display reference voltage Vpre_r may be supplied to each reference power line RL during a period for which each pixel P is charged with data. The sensing precharging voltage Vpre_s may be supplied to each reference power line RL during a sensing period for which a threshold voltage/mobility of the driving TFT DT of each pixel P is detected.

The plurality of driving power lines PL may be formed in parallel to the plurality of gate lines GL, and the first driving voltage VDD may be supplied to the plurality of driving power lines PL.

The capacitor Cst of each pixel P is charged with a difference voltage (Vdata−Vref) between the data voltage Vdata and the reference voltage Vref during a data charging period. Each pixel P includes a pixel circuit PC that supplies the data current Ioled to the organic light emitting diode OLED according to a voltage charged into the capacitor Cst during a light emitting period.

The pixel circuit PC of each pixel P includes a first switching TFT ST1, a second switching TFT ST2, the driving TFT DT, and the capacitor Cst. Here, the TFTs ST1, ST2 and DT are N-type TFTs, and for example, may be an a-Si TFT, a poly-Si TFT, an oxide TFT, or an organic TFT. However, the present invention is not limited thereto, and the TFTs ST1, ST2 and DT may be formed as P-type TFTs.

The first switching TFT ST1 has a gate connected to a corresponding gate line GL, a source (first electrode) connected to a data line DL, and a drain (second electrode) connected to a gate of the driving TFT DT.

The first switching TFT ST1 is turned on according to a gate-on voltage level of scan signal supplied to the gate line GL. When the first switching TFT ST1 is turned on, a data voltage Vdata supplied to a corresponding data line DL is supplied to a first node n1, namely, a gate of the driving TFT DT.

The second switching TFT ST2 has a gate connected to a corresponding sensing signal line SL, a source (first electrode) connected to a corresponding reference power line RL, and a drain (second electrode) connected to a second node n2 connected to the driving TFT DT and the organic light emitting diode OLED.

The second switching TFT ST2 is turned on according to a gate-on voltage level of sensing signal supplied to the sensing signal line SL. When the second switching TFT ST2 is turned on, the display reference voltage Vpre_r or sensing precharging voltage Vpre_s supplied to the reference power line RL is supplied to the second node n2.

The capacitor Cst is connected between a gate and drain of the driving TFT DT, namely, between the first node n1 and the second node n2. The capacitor Cst is charged with a difference voltage between voltages respectively supplied to the first and second nodes n1 and n2. The driving TFT DT is turned on with a voltage charged into the capacitor Cst.

The gate of the driving TFT DT is connected to the drain of the first switching TFT ST1 and a first electrode of the capacitor Cst in common. The drain of the driving TFT DT is connected to a corresponding driving power line PL.

A source of the driving TFT DT is connected to the drain of the second switching TFT ST2, a second electrode of the capacitor Cst, and an anode of the organic light emitting diode OLED.

The driving TFT DT is turned on with the voltage of the capacitor Cst at every light emitting period, and controls an amount of current flowing to the organic light emitting diode OLED according to the first driving voltage VDD.

The organic light emitting diode OLED emits light with the data current Ioled supplied from the driving TFT DT of the pixel circuit PC, thereby emitting single color light having a luminance corresponding to the data current Ioled.

To this end, the organic light emitting diode OLED includes the anode connected to the second node n2 of the pixel circuit PC, an organic layer (not shown) formed on the anode, and a cathode (not shown) that is formed on the organic layer and receives the second driving voltage VSS.

The organic layer may be formed to have a structure of hole transport layer/organic emission layer/electron transport layer or a structure of hole injection layer/hole transport layer/organic emission layer/electron transport layer/electron injection layer. Furthermore, the organic layer may further include a functional layer for enhancing a light efficiency and/or service life of the organic emission layer. In this case, the second driving voltage VSS may be supplied to the cathode of the organic light emitting diode OLED through a second driving power line (not shown) that is formed in a line shape.

The gate driver 300 operates in the driving mode and the sensing mode according to mode control by the timing controller 400. The gate driver 300 is connected to the plurality of gate lines GL and the plurality of sensing signal lines SL.

In the driving mode, the gate driver 300 generates a gate-on voltage level of scan signal at every one horizontal period, according to the gate control signal GCS supplied from the timing controller 400. The scan signal is sequentially supplied to the plurality of gate lines GL.

The scan signal has a gate-on voltage level during a data charging period of each pixel P. The scan signal has a gate-off voltage level during a light emitting period of each pixel P. The gate driver 300 may be a shift register that sequentially outputs the scan signal.

The gate driver 300 generates a gate-on voltage level of sensing signal at every initialization period and sensing voltage charging period of each pixel P. The gate driver 300 sequentially supplies the sensing signal to the plurality of sensing signal lines SL.

The gate driver 300 may be configured in an integrated circuit (IC) type, or may be directly provided in a substrate of the display panel 100 in a process of forming the TFTs of the respective pixels P.

The gate driver 300 is connected to the plurality of driving power lines PL1 to PLm, and supplies a driving voltage VDD, supplied from an external power supply (not shown), to the plurality of driving power lines PL1 to PLm.

The data driver 200 is connected to the plurality of data lines D1 to Dn, and operates in the display mode and the sensing mode according to mode control by the timing controller 400.

The driving mode for displaying an image may be driven in the data charging period, for which each pixel is charged with a data voltage, and the light emitting period for which each organic light emitting diode OLED emits from light. The sensing mode may be driven in the initialization period for which each pixel is initialized, the sensing voltage charging period, and a sensing period.

As illustrated in FIG. 4, the data driver 200 includes a data voltage generating unit 210, a sensing data generating unit 230, and a switching unit 240.

The data voltage generating unit 210 converts the input pixel data DATA into data voltages Vdata, and supplies the data voltages Vdata to the respective data lines DL. To this end, the data voltage generating unit 210 includes a shift register, a latch, a grayscale voltage generator, a digital-to-analog converter (DAC), and an output unit.

The shift register generates a plurality of sampling signals, and the latch latches the pixel data DATA according to the sampling signals. The grayscale voltage generator generates a plurality of grayscale voltages with a plurality of reference gamma voltages, and the DAC selects grayscale voltages corresponding to the latched pixel data DATA from among the plurality of grayscale voltages as data voltages Vdata to output the selected data voltages. The output unit outputs the data voltages Vdata.

The switching unit 240 includes a plurality of first switches 240*a* and a plurality of second switches 240*b*.

The plurality of first switches 240*a* switch the data voltages Vdata or a reference voltage Vpre_d to the respective data lines DL in the driving mode.

The plurality of second switches 240*b* switch the display reference voltage Vpre_r or the sensing precharging voltage Vpre_s so as to be supplied to the reference power lines RL in the sensing mode. Subsequently, the plurality of second switches 240*b* float the reference power lines RL. Then, each of the plurality of second switches 240*b* connects a corresponding reference power line RL to the sensing data generating unit 230, thereby allowing the driving TFT of a corresponding pixel to be sensed.

The sensing data generating unit 230 is connected to the reference power lines RL by the switching unit 240, and senses a voltage charged into each of the reference power lines RL. Subsequently, the sensing data generating unit 230 generates digital sensing data corresponding to the sensed analog voltage, and supplies the digital sensing data to the timing controller 400.

As an example, the sensing data generating unit 230 may supply the sensing precharging voltage Vpre_s to the reference power lines RL corresponding to the respective pixels according to a user's setting using an input device 600, and sense the characteristic of the driving TFT of each pixel. Here, the sensing precharging voltage Vpre_s may be supplied at 1 V.

As another example, the sensing data generating unit 230 may be driven for a certain time according to control by the timing controller 400, and automatically driven in the sensing mode. At this time, the sensing data generating unit 230 may supply the sensing precharging voltage Vpre_s to the reference power lines RL corresponding to the respective pixels according to a user's setting using an input device 600, and sense the characteristic of the driving TFT of each pixel. Here, the sensing precharging voltage Vpre_s may be supplied at 1 V.

As another example, a sensing and compensation time may be set according to a user's setting using the input device 600. The sensing data generating unit 230 may be driven in the sensing mode at the set time. At this time, the sensing data generating unit 230 may supply the sensing precharging voltage Vpre_s to the reference power lines RL corresponding to the respective pixels, and sense the characteristic of the driving TFT of each pixel. Here, the sensing precharging voltage Vpre_s may be supplied at 1 V.

In the above-described sensing mode, the reference power lines RL are floated through the respective second switches 240*b*. Subsequently, each of the plurality of second switches 240*b* connects a corresponding reference power line RL to the sensing data generating unit 230, thereby allowing a corresponding pixel to be sensed.

A voltage sensed from a corresponding reference power line RL by the sensing data generating unit 230 may be decided at a ratio of a current (flowing in a corresponding driving TFT DT) and a capacitance of the reference power line RL with time. Here, the sensing data is data corresponding to a threshold voltage/mobility of the driving TFT DT of each pixel P.

As another example, in the real-time sensing mode, the plurality of switches 240*b* are switched during the blank interval between the nth frame and the n+1st frame, and the sensing data generating unit 230 supplies the sensing precharging voltage Vpre_s to one reference power line RL or the plurality of reference power lines RL. For example, the sensing precharging voltage Vpre_s may be supplied at 1 V.

Subsequently, the second switch 240*b* is turned on, and floats a corresponding reference power line RL receiving the sensing precharging voltage Vpre_s. Then, the reference power line RL is connected to the sensing data generating unit 230, thereby allowing a corresponding pixel to be sensed.

Figure 5:
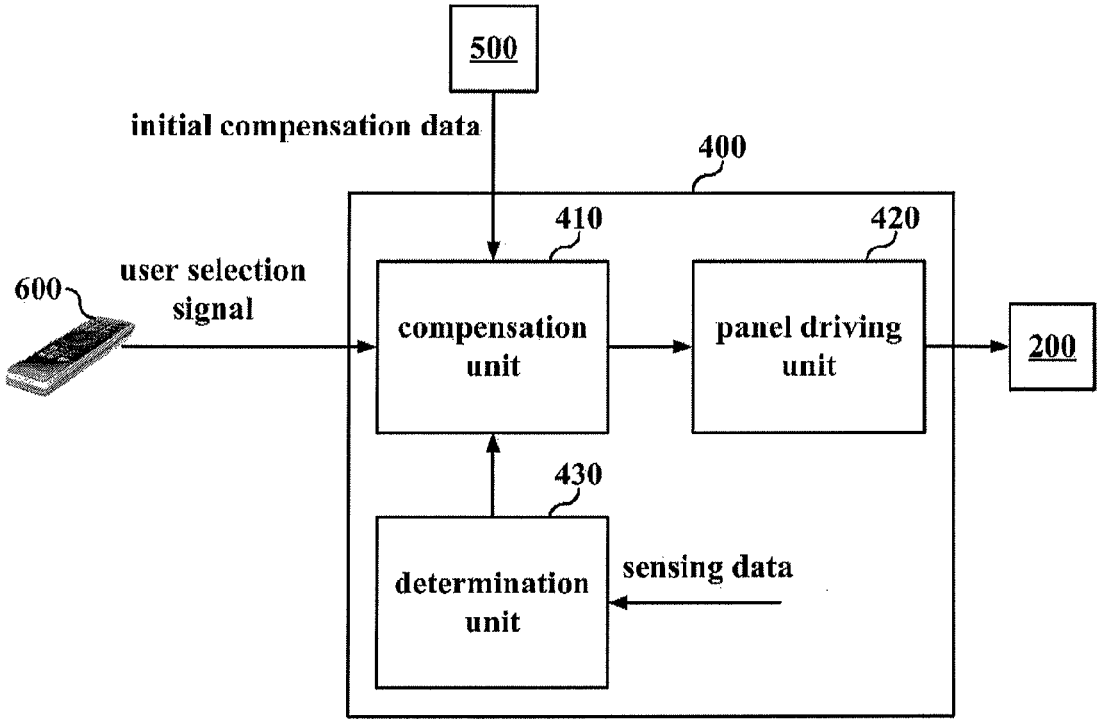
FIG. 5 is a circuit diagram for describing a timing controller of the organic light emitting display device according to an embodiment of the present invention.

FIG. 5 is a circuit diagram for describing a timing controller of the organic light emitting display device according to an embodiment of the present invention.

Referring to FIG. 5, a timing controller 400 includes a compensation unit 410, a panel driving unit 420, and a determination unit 430.

Here, the timing sync signal TSS may include a vertical sync signal Vsync, a horizontal sync signal Hsync, a data enable signal DE, and a clock DCLK.

The timing controller 400 generates a gate control signal GCS and a data control signal DCS with the timing sync signal TSS. The gate control signal GCS for controlling the gate driver 300 may include a gate start signal and a plurality of clock signals. The data control signal DCS for controlling the data driver 200 may include a data start signal, a data shift signal, and a data output signal.

In the sensing mode, the timing controller 400 drives the data driver 200 and the gate driver 300 in the sensing mode by using the data control signal DCS and the gate control signal GCS. In the sensing mode, the timing controller 400 generates predetermined detection data, and supplies the detection data to the data driver 200.

As an example, the timing controller 400 may operate the data driver 200 in the sensing mode according to a user's setting using the input device 600.

As another example, the timing controller 400 may be driven for a certain time, and then may automatically operate the data driver 200 in the sensing mode.

As another example, a sensing and compensation time may be set according to a user's setting using the input device 600, and the timing controller 400 may operate the data driver 200 in the sensing mode.

Here, the input device 600 generates a compensation mode selection signal according to selection of the compensation mode by the user. The input device 600 supplies the compensation mode selection signal to the compensation unit 410 of the timing controller 400. The input device 600 includes various menu items for the compensation mode, and includes a wired/wireless communication interface that enables the input device 600 to communication with the timing controller 400.

In the sensing mode according to the user's setting, the timing controller 400 may detect the threshold voltage/mobility of the driving TFT DT of each pixel P of the display panel 100 during a period of one frame or a period (driving period) of a plurality of frames.

In a real-time sensing mode using the blank interval, the timing controller 400 may detect the threshold voltage/mobility of the driving TFT DT of a plurality of pixels P formed on one horizontal line at every blank interval. The timing controller 400 may detect the threshold voltage/mobility of the driving TFT DT of each pixel P of the display panel 100 during a blank interval of a plurality of frames.

In the driving mode, the timing controller 400 corrects external input data Idata on the basis of detection data Dsen of the respective pixels P which are supplied from the data driver 200 in the sensing mode. Furthermore, the timing controller 400 reflects the correction of the input data to generate pixel data DATA, and supplies the generated pixel data DATA to the data driver 200.

In this case, the pixel data DATA to be supplied to each pixel P has a voltage level in which a compensation voltage for compensating for a change in characteristic (threshold voltage/mobility) of the driving TFT DT of each pixel P is reflected.

The input data Idata may include input red, green, and blue data to be supplied to one unit pixel. Furthermore, when the unit pixel is configured with a red pixel, a green pixel, and a blue pixel, one piece of pixel data DATA may be red data, green data, or blue data.

On the other hand, when the unit pixel is configured with a red pixel, a green pixel, a blue pixel, and a white pixel, one piece of pixel data DATA may be red data, green data, blue data, or white data.

The determination unit 430 of the timing controller 400 loads sensing data, generated by sensing driving, from the data driver 200. Also, the determination unit 430 analyzes the sensing data to determine whether to perform a compensation driving operation on the characteristic of the driving TFTs of all or some of the pixels.

The determination unit 430 analyzes the sensing data, and when an error of the sensing data occurs, the determination unit 430 controls the compensation unit 410 to perform the compensation mode. However, when an error of the sensing data does not occur, the determination unit 430 disallows the compensation mode to be performed. Subsequently, the determination unit 430 supplies the determined result of compensation driving to the compensation unit 410.

Moreover, in the driving mode, the determination unit 430 checks a real-time sensing error. When an sensing error occurs due to an image being displayed for a long time, the determination unit 430 controls the compensation unit 410 such that an initial compensation mode is automatically performed.

The compensation unit 410 may restore each pixel of the display panel 100 to an initial state. At this time, the compensation unit 410 loads initial compensation data stored in the memory 500 to compensate for each pixel to the initial state.

The compensation unit 410 calculates a change in characteristic of the driving TFT of each pixel by using the sensing data. At this time, the compensation unit 410 loads the initial compensation data stored in the memory 500. Subsequently, the compensation unit 410 calculates a change in characteristic of the driving TFT of each pixel to generate compensation data on the basis of the initial compensation data and the sensing data. In this case, the compensation unit 410 may store the compensation data generated by the calculation in the memory to update the compensation data. The compensation unit 410 supplies the generated compensation data to the panel driving unit 420.

The display panel has been manufactured, and then, before a product is released, the initial compensation data may be stored in the memory 500. The initial compensation data is stored in the memory 500 for compensating for the characteristics of the driving TFTs of all the pixels on the basis of the sensing data generated by sensing the driving TFTs of all the pixels before the product is released.

As another example, the compensation unit 410 loads the initial compensation data stored in the memory 500 according to a user's selection using the input device 600. The compensation unit 410 may initialize the characteristic of the driving TFT of each pixel by using the loaded initial compensation data.

In the sensing mode, the panel driving unit 420 of the timing controller 400 may generate the predetermined detection data, and supplies the detection data to the data driver 200, thereby allowing the driving TFT of each pixel to be sensed.

In the driving mode, the panel driving unit 420 of the timing controller 400 converts input image data into data voltages Vdata by using the compensation data.

Specifically, in the driving mode, the panel driving unit 420 corrects the external input data Idata by using first compensation data based on sensing data generated in the sensing mode according to the user's setting using the input device 600. Subsequently, the panel driving unit 420 may supply the corrected pixel data DATA to the data driver 200 to compensate for the characteristic of the driving TFT of each pixel.

Moreover, in the driving mode, the panel driving unit 420 corrects the external input data Idata by using second compensation data based on sensing data generated in the sensing mode which is automatically performed after driving is performed for a certain time. Subsequently, the panel driving unit 420 may supply the corrected pixel data DATA to the data driver 200 to compensate for the characteristic of the driving TFT of each pixel.

In this case, the pixel data DATA to be supplied to each pixel P has a voltage level in which a compensation voltage for compensating for a change in characteristic (threshold voltage/mobility) of the driving TFT DT of each pixel P is reflected. Like this, the panel driving unit 420 supplies the data voltage Vdata to the respective pixels of the display panel 100 to enable an image to be displayed, and compensates for the pixels in real time.

Figure 6:
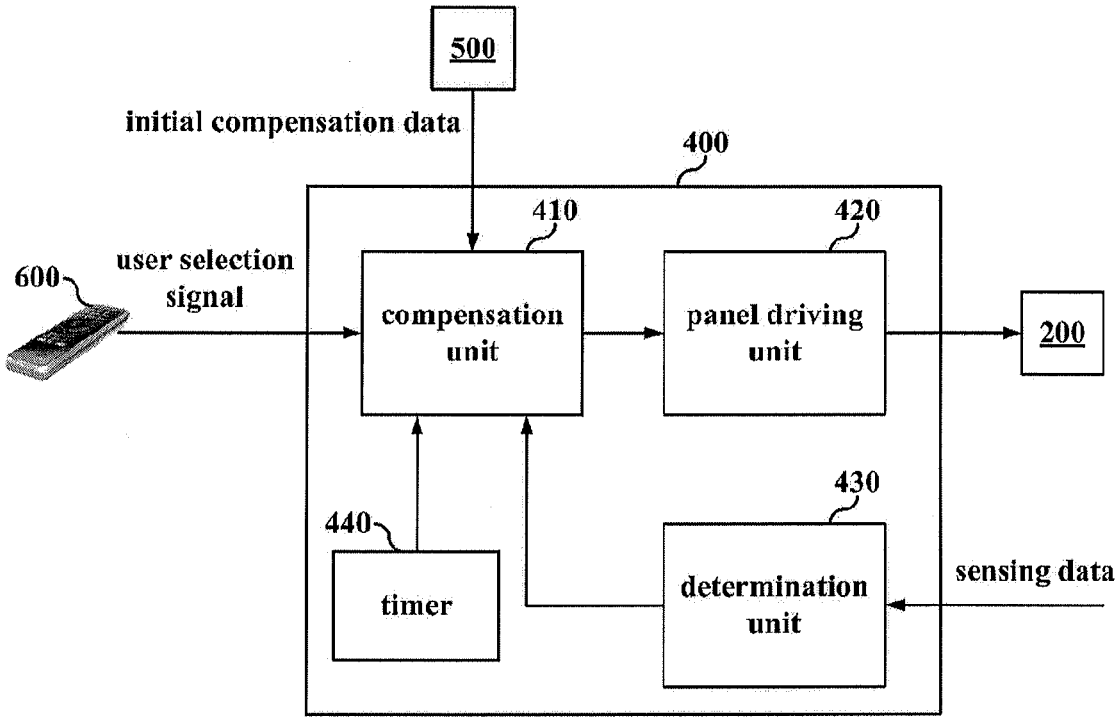
FIG. 6 is a circuit diagram for describing a timing controller of an organic light emitting display device according to another embodiment of the present invention.

FIG. 6 is a circuit diagram for describing a timing controller of an organic light emitting display device according to another embodiment of the present invention.

Referring to FIG. 6, a timing controller 400 of an organic light emitting display device according to another embodiment of the present invention additionally includes a timer 440 whose a sensing driving and compensation driving time is set by a user's setting using the input device 600.

The compensation mode selection signal is inputted to the compensation unit 410 by the input device 600, and a reservation time at which the sensing mode and compensation mode of each pixel of the display panel 100 are performed may be set in the timer 440 by using the input device 600.

When a reservation time of sensing driving and compensation driving set by a user arrives, the timer 440 requests the sensing driving and compensation driving according to the user's selection. Therefore, the timing controller 400 senses the characteristic of the driving TFT of each pixel of the display panel 100 to generate sensing data.

In the driving mode, the panel driving unit 420 corrects the external input data Idata by using third compensation data based on sensing data generated in the sensing mode, according to the user's reservation of sensing driving and compensation driving using the input device 600. Subsequently, the panel driving unit 420 may supply the corrected pixel data DATA to the data driver 200 to compensate for the characteristic of the driving TFT of each pixel.

When a user perceives a degradation of an image quality which is caused by a deterioration of a driving TFT of a pixel due to an image being displayed for a long time, the above-described organic light emitting display device and method of driving the same according to the embodiments of the present invention enable the user to personally perform the sensing driving and compensation driving of each pixel by using the input device 600.

Therefore, a user can actively respond to a degradation of an image quality. Also, when a degradation of an image quality is perceived by a user's eyes, the user can restore all the pixels of the display panel to the initial state without needing to visit a service center of a manufacturer.

Moreover, the organic light emitting display device and the method of driving the same according to the embodiments of the present invention enable a user to reserve an operation time of the initial compensation mode by using the input device 600. Accordingly, the user can restore all the pixels of the display panel to the initial state at a time instead of a viewing time Moreover, when an image is displayed for a certain time, the organic light emitting display device and the method of driving the same according to the embodiments of the present invention automatically perform the initial compensation mode, and thus can restore all the pixels of the display panel to the initial state. In this case, the sensing and compensation of each pixel in the initial compensation mode are performed at every accurate period, and thus, a service life of the organic light emitting display device can be extended, and a uniformity of an image quality can be maintained.

Moreover, when the determination unit 430 detects a sensing error due to an image being displayed for a long time, the organic light emitting display device and the method of driving the same according to the embodiments of the present invention automatically perform the initial compensation mode, and thus can restore all the pixels of the display panel to the initial state.

The organic light emitting display device and the method of driving the same according to the embodiments of the present invention can sense all pixels of the display panel and compensate for the pixels according to a user's setting.

The organic light emitting display device and the method of driving the same according to the embodiments of the present invention can sense a characteristic of the driving TFT of each pixel and compensate for the characteristic of the driving TFTs, without turning off a screen.

The organic light emitting display device and the method of driving the same according to the embodiments of the present invention can prevent the driving TFTs from being deteriorated due to long-time driving, and increase a display quality of an image.

The organic light emitting display device and the method of driving the same according to the embodiments of the present invention can compensate for each pixel of the display panel to the initial state according to a user's selection.

The organic light emitting display device and the method of driving the same according to the embodiments of the present invention can reduce real-time sensing errors and thus increase an accuracy of real-time compensation.

The organic light emitting display device and the method of driving the same according to the embodiments of the present invention can prevent a service life of the display panel from being shortened due to a sensing error.

The organic light emitting display device and the method of driving the same according to the embodiments of the present invention can increase a reliability of the display panel.

In addition to the aforesaid features and effects of the present invention, other features and effects of the present invention can be newly construed from the embodiments of the present invention.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of driving an organic light emitting display device which includes a display panel including a plurality of pixels including a pixel circuit for emitting light from an organic light emitting diode and a driving circuit unit driving the display panel, the method comprising:

sensing a characteristic of a driving thin film transistor (TFT) of each of the pixels of the display panel to generate sensing data according to a user's setting using an input device, at a predetermined compensation driving time, or when an error occurs in sensing data generated by real-time sensing of each pixel of the display panel; and compensating for the characteristic of the driving TFT of each pixel by using the sensed data.

2. The method of claim 1, further comprising setting an operation time of an initial compensation mode, wherein at the operation time of the initial compensation mode, sensing comprise sensing the characteristic of the TFT of each pixel of the display panel to generate sensing data, and compensating comprises compensating for the characteristic of the driving TFT of each pixel by using the sensing data.

3. The method of claim 1, further comprising:

loading initial compensation data of the display panel stored in a memory; and calculating a change in characteristic of the driving TFT of each pixel to generate compensation data, on the basis of the initial compensation data and the sensing data.

4. The method of claim 1, further comprising:

loading initial compensation data of the display panel stored in a memory; and compensating for all the pixels to an initial state by using the initial compensation data.

5. An organic light emitting display device, which includes a display panel including a plurality of pixels including a pixel circuit for emitting light from an organic light emitting diode and a driving circuit unit driving the display panel, comprising:

a determination unit configured to load sensing data, generated by sensing driving, from a data driver of the driving circuit, and analyze the sensing data to determine whether to perform a compensation mode on a characteristic of driving thin film transistors (TFTs) of all or some of the plurality of pixels;

a compensation unit configured to calculate a change in characteristic of the driving TFT of each of the plurality of pixels by using the sensing data to generate compensation data used to compensate for the characteristic of the driving TFT of each pixel;

a panel driving unit configured to correct external input data by using the compensation data to supply the corrected pixel data to the data driver, according to an input compensation mode, a predetermined compensation driving time, or the determined result by the determination unit; and an input device configured to generate a compensation mode selection signal according to selection of the compensation mode by a user, and supply the compensation mode selection signal to the compensation unit.

6. The organic light emitting display device of claim 5, further comprising a timer configured to have a sensing driving and compensation driving time of each pixel set by the compensation mode selection signal from the input device.

7. The organic light emitting display device of claim 5, wherein a driving time of the display panel is set, and the characteristic of the driving TFT of each pixel is compensated for at certain time intervals.

8. The organic light emitting display device of claim 7, wherein, the driving time of the display panel is set, and initial compensation data of the display panel stored in a memory is loaded at certain time intervals, and all the pixels are compensated for to an initial state by using the initial compensation data.

* * * * *